US006243997B1

(12) United States Patent
Sannipoli

(10) Patent No.: US 6,243,997 B1
(45) Date of Patent: Jun. 12, 2001

(54) VAULT LID

(75) Inventor: Wayne P. Sannipoli, Escondido, CA (US)

(73) Assignee: Alfred L. Sannipoli, Sr., Temecula, CA (US)

( * ) Notice: Subject to any disclaimer, the term of this patent is extended or adjusted under 35 U.S.C. 154(b) by 0 days.

(21) Appl. No.: 09/356,153

(22) Filed: Jul. 19, 1999

(51) Int. Cl.[7] ..... E04H 13/00
(52) U.S. Cl. ..... 52/128; 52/136
(58) Field of Search ..... 52/128, 133, 136, 52/137; 40/124.5

(56) References Cited

U.S. PATENT DOCUMENTS

| | | | | |
|---|---|---|---|---|
| 240,372 | * | 4/1881 | Bower | 52/139 |
| 324,167 | * | 8/1885 | Robey | 52/133 |
| 510,696 | * | 12/1893 | Mease | 40/124.5 |
| 1,004,273 | * | 9/1911 | Johnson | 52/139 |
| 1,815,883 | | 7/1931 | Davis . | |
| 2,024,047 | | 12/1935 | Kropp . | |
| 2,034,633 | | 3/1936 | Roberts . | |
| 3,312,014 | * | 4/1967 | Pfister, III . | |
| 3,501,874 | | 3/1970 | Hahne . | |
| 3,581,452 | * | 6/1971 | Jalbert | 52/133 |
| 5,746,030 | | 5/1998 | Sannipoli, Sr. . | |
| 6,088,955 | * | 7/2000 | Nelson, Jr. et al. . | |

FOREIGN PATENT DOCUMENTS

| | | | | |
|---|---|---|---|---|
| 329430 | * | 11/1920 | (DE) | 52/128 |
| 9104381 | * | 4/1991 | (WO) | 52/128 |

* cited by examiner

*Primary Examiner*—Blair M. Johnson
(74) *Attorney, Agent, or Firm*—Brown, Martin, Haller & McClain, LLP

(57) ABSTRACT

A flat, rectangular lid member is designed to releasably close the open upper end of a burial vault. The lid member has an upper face, a lower face, opposite first and second ends, and opposite sides. A headstone holder formed integrally with or separate from the lid member projects upwardly from the upper face of the first end of the lid member. The headstone holder has an upright, rectangular cavity with an open upper end for receiving the lower end of a headstone to support the headstone in an upright position.

20 Claims, 2 Drawing Sheets

VAULT LID

BACKGROUND OF THE INVENTION

The present invention relates to vaults and is particularly concerned with a lid for a burial or cemetery vault or crypt.

Double or single vaults are often used for interment of caskets in cemeteries. Such vaults are hollow, box-like structures of cement or the like with a removable lid for inserting a coffin or casket. The vault is designed to provide a substantially sealed chamber to protect the coffin. A double vault assembly of this type is described in U.S. Pat. No. 5,746,030 of Sannipoli.

Currently, a large gap of the order of 30" is required between crypts or vaults in cemeteries. Without this gap, headstones marking adjacent graves may move during an interment, due to soil movement and the like. In cemeteries where space is at a premium, such as military cemeteries, a gap this large between grave sites is a problem.

SUMMARY OF THE INVENTION

It is an object of the present invention to provide a new and improved vault lid for permitting vaults to be interred closer together than is currently possible.

According to the present invention, a vault lid assembly is provided, which comprises a flat, rectangular lid member for releasably closing the open upper end of a burial vault, the lid member having an upper face, a lower face, and opposite first and second ends, and a headstone holder projecting upwardly from the upper face at one end of the lid member, the headstone holder having a vertical cavity with an open upper end for receiving the lower end of a headstone and holding the headstone in an upright position. The headstone holder is preferably a rectangular, box-shaped enclosure.

In one embodiment for use with single or multi-level vaults, the lid member and headstone holder are formed integrally in one piece. In a second embodiment, for use with double or multi-level vaults, the lid member has a first part extending from the second end to a location adjacent the first end, and a second, separate end part forming a first end portion of the lid, and the headstone holder extends upwardly from the second end part. The first and second parts have releasable locating formations for locating the first part and the second end part together over the open end of a vault. The headstone holder may be formed separately from the second part of the lid, and have a tongue and groove type releasable engagement with the second part.

In the second embodiment, the crypt or vault will normally be pre-buried with the two part lid on top, without the headstone holder. At the first interment, both parts of the lid are removed, and the casket is inserted into the lower level of the vault. The lid is then replaced, and the headstone holder is installed on top of the second part of the lid. The lower end of the headstone is then inserted into the open upper end of the headstone holder, and slides down into the cavity. Gravel is placed in the cavity around the headstone to hold it in an upright position. At the second interment, the first part only of the lid is removed. The casket is angled to slide into the upper level of the vault, and the first part of the lid is replaced, without disturbing the headstone.

This arrangement avoids the need to remove the headstone when a second burial is carried out in a multi-level vault, and thus also avoids the necessary re-alignment of the headstone after a second burial. This is much less work for the burial crew. Both embodiments also permit burial sites to be located much closer together, since the headstones at adjacent sites will be held upright by the rigid headstone holder while the grave is being dug.

In practice, this invention may permit grave site spacings of the order of ½", with the resultant saving of space in a cemetery.

BRIEF DESCRIPTION OF THE DRAWINGS

The present invention will be better understood from the following detailed description of some preferred embodiments of the invention, taken in conjunction with the accompanying drawings in which like reference numerals refer to like parts and in which.

DESCRIPTION OF THE PREFERRED EMBODIMENTS

Figure 1:
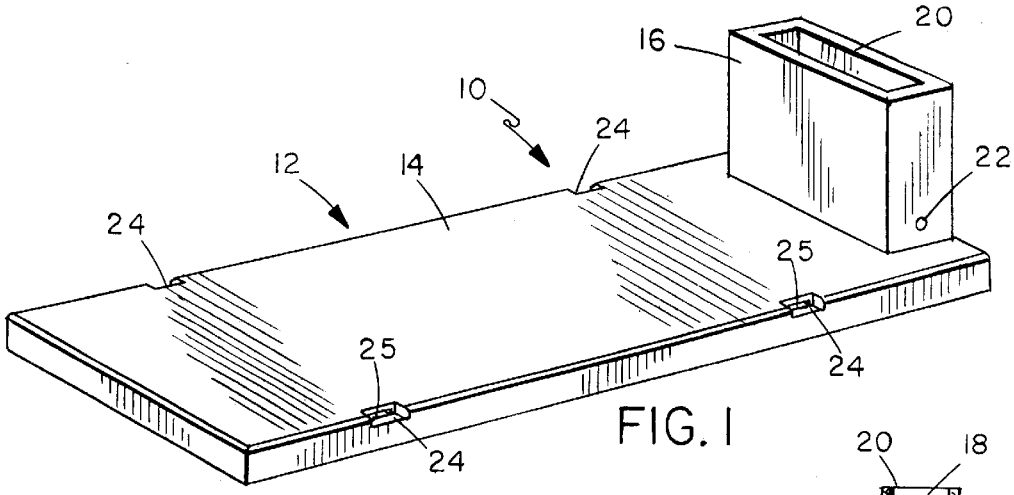
FIG. 1 is a perspective view of a vault lid according to a first embodiment of the invention with an integral headstone holder.
Figure 2:
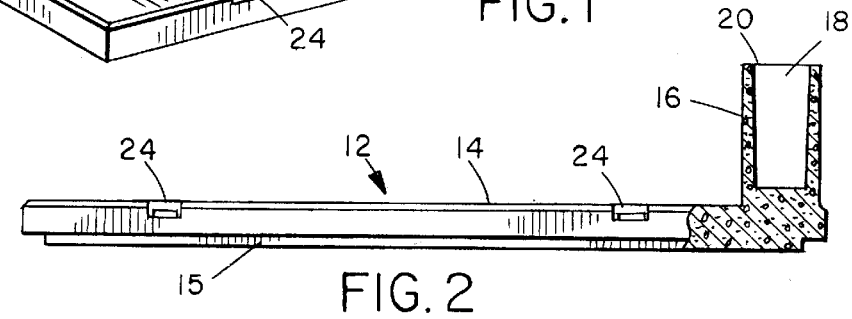
FIG. 2 is a side view of the lid with a portion cut away.
Figure 5:
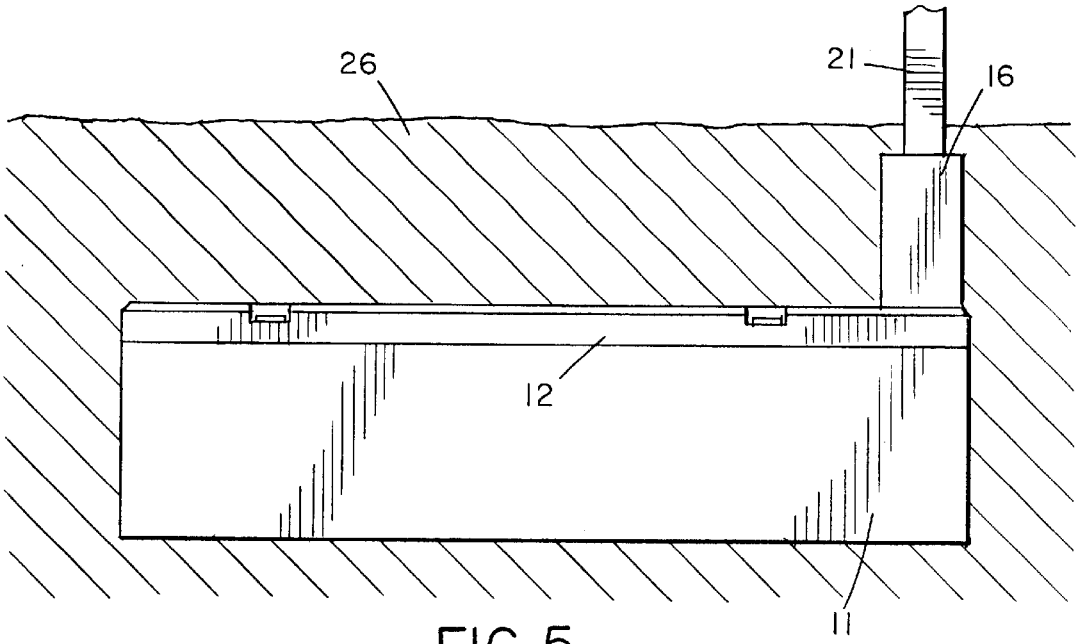
FIG. 5 is a side view of the lid of FIG. 1 on a buried vault.

FIGS. 1 and 2 illustrate a vault lid 10 according to a first embodiment of the present invention, which is designed to cover the open upper end of a buried vault or crypt 11, as illustrated in FIG. 5. The lid 10 is formed of a suitable rigid and corrosion-resistant material such as cement or the like, and comprises a flat, generally rectangular lid member 12 with an upper face 14, a lower face 15, and an integrally formed headstone holder 16 projecting upwardly from upper face 14 at a first end of the lid member.

The headstone holder 16 comprises a generally rectangular, box-like member having an internal cavity 18 with an open upper end 20, which is of suitable shape and dimensions for receiving the lower end of a headstone 21. A drain hole 22 is formed at the lower end of the cavity 18 for draining of any water accumulating in the cavity.

Lid member 12 has two opposing pairs of indents or lifting pockets 24 along opposite sides with channels or openings 25 at their inner ends for receiving claws or clamps of a hoist or the like for raising and lowering the lid member, as is known in the field.

In this embodiment, the lid member 12 and headstone holder 16 are formed integrally. This is particularly suitable for providing a lid for a single level vault or crypt, which does not have to be re-opened for subsequent interments. The vault is first installed in the grave, and the casket is inserted into the vault before replacing the lid 10. The lower end of a headstone 11 is then inserted into cavity 18, and the space surrounding the headstone in the cavity is filled with gravel or the like so that the headstone is held upright. The hole is then filled with dirt 26 or the like so that the lid member, headstone holder, and lower end of the headstone are covered, as illustrated in FIG. 5. With this arrangement, the headstone is securely supported in an upright condition and will not tilt or move when adjacent graves are excavated. This allows graves to be placed much closer together than was previously possible.

Figure 3:
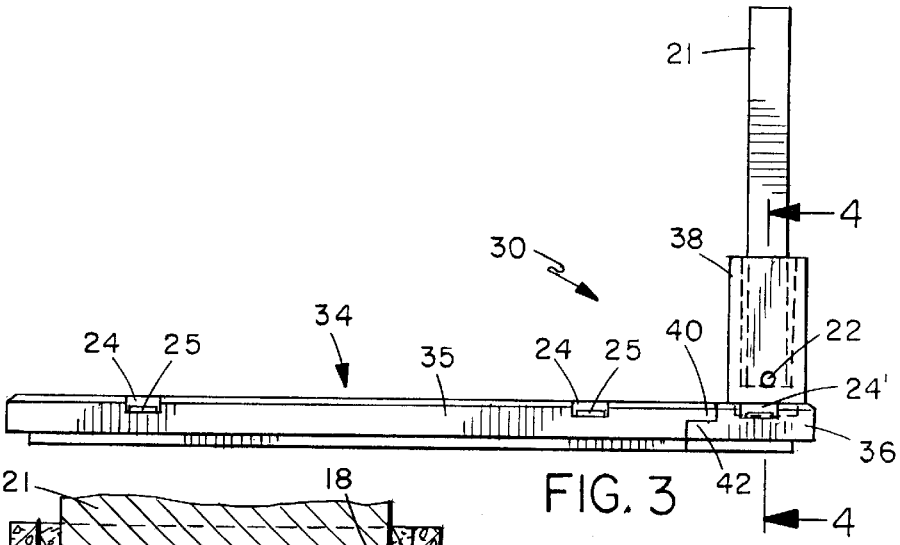
FIG. 3 is a side view of a lid according to a second embodiment of the invention with a detachable headstone holder and a separable lid portion.
Figure 4:
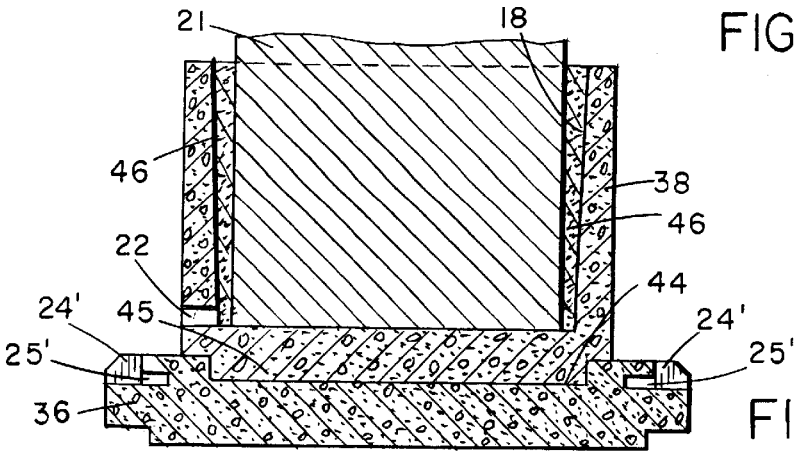
FIG. 4 is an enlarged sectional view taken on line 4—4 of FIG. 3.
Figure 6:
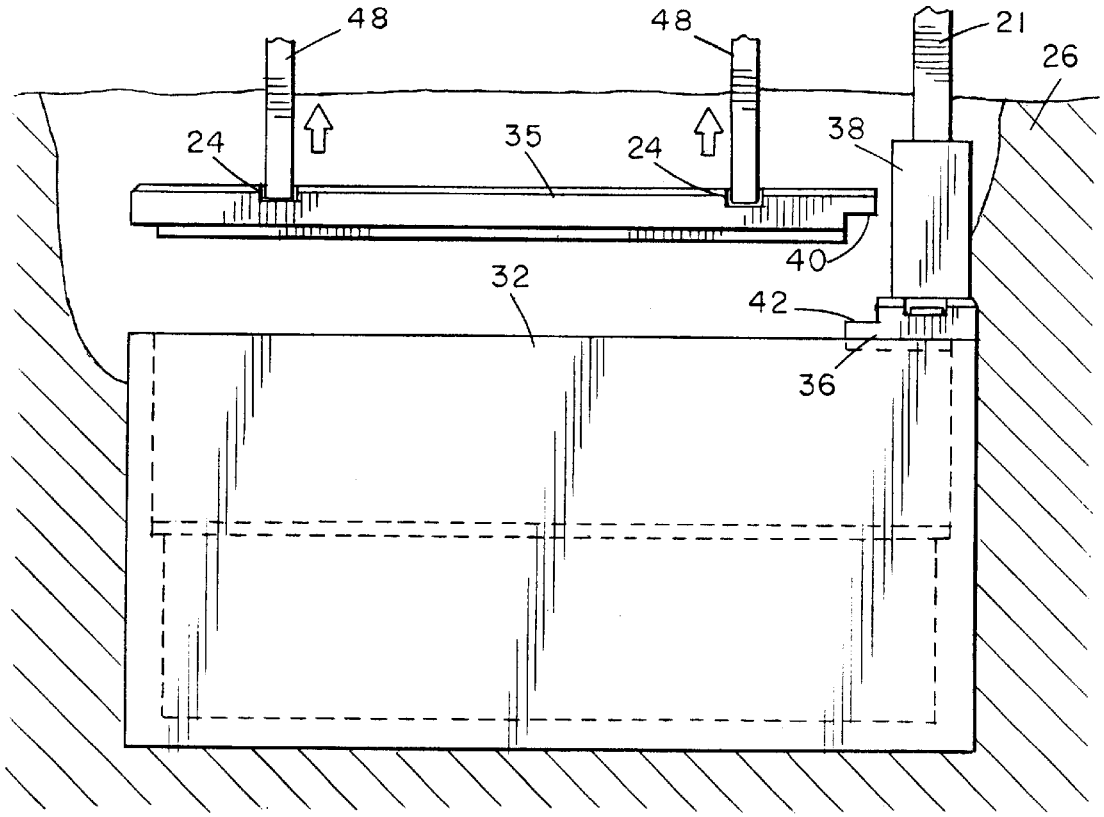
FIG. 6 is a side view of the lid of FIG. 3 on a buried multiple level vault, with the upper portion excavated for removal of the separable lid portion.

FIGS. 3, 4 and 6 illustrate a vault lid assembly 30 according to a second embodiment of the invention which is designed for use with a double or multi-level vault 32, as illustrated in FIG. 6. The assembly 30 includes a lid 34 of similar shape and dimensions to lid member 12 of FIGS. 1 and 2, but formed in two separate parts 35,36. The first part 35 extends for most of the length of the lid, while the second part 36 forms a separate end portion of the lid and a support for a separate headstone holder 38. Apart from being formed in three separate parts, the lid assembly 30 is otherwise similar to that of FIGS. 1 and 2 and like reference numerals have been used for like parts as appropriate.

The first part 35 of the lid is formed with a downwardly facing ledge or step 40 at one end which is designed to engage over a matching, upwardly facing ledge or step 42 on the mating end of the second part 36, as best illustrated in FIGS. 3 and 6. The second part 36 is formed with a pair of opposing lifting pockets 24' with openings 25' similar to pockets 24 and openings 25 on the opposite sides of part 35. Part 36 also has an upwardly facing groove or channel 44. The headstone holder 38 has a downwardly projecting rib or tongue 45 for releasable mating engagement in the channel 44, as illustrated in FIG. 4.

The arrangement of FIGS. 3,4 and 6 allows a vault 32 to be preburied in a prepared hole in soil 26, with the two part lid 34 positioned over the vault without the headstone holder. At the time of the first interment, the grave is excavated to uncover the lid 34, and the lid is pulled off, using a suitable hoist or lifting device with claws engaging in openings 25 in the first part 35, and subsequently in openings 25' in the second part 36. The first casket is then lowered into the lowermost space in the vault, and covered by an intermediate floor member, for example as described in U.S. Pat. No. 5,746,030 referred to above. The two part lid 34 is then lowered into position over the vault with the headstone holder 38 engaging in channel 44 as illustrated in FIG. 4. The second part 36 will first be lowered into position over one end of the open upper end of the vault, and the first part 35 is then lowered until step rests on top of step to properly locate the lid parts together. The lower end of the headstone 11 can then be lowered into the cavity 18, and the space around the headstone is filled with sand or gravel 46 while the headstone is held upright. The remainder of the excavation is then re-filled with soil.

At the next interment, the headstone 11, holder 38, and second part 36 of the lid do not have to be disturbed. All that is necessary is for the grave to be excavated so as to uncover the lid, and the first part 35 of the lid to be lifted off using claws or clamps 48, as indicated by the arrows in FIG. 6. The second casket is then angled slightly downwardly so as to slide into the upper cavity of the vault. Lid part 35 is then replaced over the vault, and the excavation can be re-filled with soil. Thus, there is no need to remove the headstone 11 in order to conduct a second burial, avoiding the need for re-alignment after a second interment. This reduces the amount of work required in the second burial.

In each of the above embodiments, the dimensions of the lid 14 and 34 are of the order of 90" (2.28 m) by 34" (0.86 m) by 4" ($10.16\times10^{-2}$ m). The headstone holder has a height of the order of 17" to 18" ($43\times10^{-2}$ m to $45.7\times10^{-2}$ m) and a width of the order of 24" (0.61 m), with the cavity having a depth of around 15" to 16" (0.38 m to 0.41 m), a width of around 21" (0.53 m), and a transverse thickness of 6" ($15.2\times10^{-2}$ m). The cavity side walls and opposite end walls flare slightly outwardly from the lower end of the cavity up to the open upper end, for easier insertion of the headstone. The headstone dimensions will be of the order of 3"×18"×42" (0.07 m×0.46 m×1.1 m), so that around 24" (0.61 m) of the headstone will project above the ground level. In the second embodiment, the length of the first part 35 of the lid is around 88" (2.23 m) while the length of the second, end part 36 is around 12" (0.31 m).

Instead of a one piece lid with an integral headstone holder, as in FIGS. 1 and 2, or a three piece lid assembly as in FIGS. 3 and 4, the lid member 14 may be in one piece as in FIG. 1, with the headstone holder formed separately and having a tongue and groove engagement with one end of the lid member as in FIG. 4. This would also be suitable for a multilevel crypt or vault, but would require removal of the headstone and holder as well as the lid for subsequent interments.

In both of the above embodiments, the headstone 11 is securely held upright during adjacent burials or subsequent burials in a multi-level vault. This allows graves to be positioned much closer together than was possible in the past, and also reduces or eliminates the risk of a headstone tilting with time as a result of soil subsidence, dampness, erosion or the like. With this invention, a spacing of less than 10" ($25.4\times10^{-2}$ m) between adjacent graves is possible, whereas in the past a spacing of at least 30" ($76.2\times150^{-2}$ m) was necessary to avoid movement of adjacent headstones when burials are carried out. In fact, a spacing of around ½" ($1.27\times10^{-2}$ m) is possible with this invention. This invention also avoids the need for precise alignment of a headstone, since it will be automatically aligned at the head of a vault by insertion in the headstone holder.

Although a preferred embodiment of the invention has been described above by way of example only, it will be understood by those skilled in the field that modifications may be made to the disclosed embodiment without departing from the scope of the invention, which is defined by the appended claims.

I claim:

1. A lid assembly for a burial vault, comprising:

a flat, rectangular lid member for releasably closing the open upper end of a burial vault, the lid member having an upper face, a lower face, opposite first and second ends, and opposite sides; and a headstone holder projecting upwardly from the upper face of the first end of the lid member;

the headstone holder having a vertically extending, generally box shaped, rectangular cavity with an upper open end receiving the lower end of a flat rectangular headstone and supporting the headstone in an upright position.

2. The assembly as claimed in claim 1, wherein the lid member and headstone holder are formed integrally.

3. The assembly as claimed in claim 1, wherein the headstone holder is formed separately from the lid member, the headstone holder having a lower face and the upper face of the first end of the lid member and the lower face of the headstone holder having interengaging formations for releasably securing the headstone holder to the lid member.

4. The assembly as claimed in claim 3, wherein the upper face of the lid member has an elongate channel at said first end and the lower face of the headstone holder has a downwardly projecting rib for releasable engagement in said channel, the channel and rib comprising said interengaging formations.

5. The assembly as claimed in claim 1, wherein the lid member is formed in separate first and second parts, the first part extending from said second end over a major portion of the length of the lid member and the second part extending from said first part up to said first end, the first and second lid parts having mating ends, the mating ends having interengaging formations for releasably locating the first and second parts together over the open end of a vault.

6. The assembly as claimed in claim 5, wherein the length of said first part is at least seven times that of the second part.

7. The assembly as claimed in claim 5, wherein the mating end of the first part has a downwardly facing step and the mating end of the second part has a corresponding, upwardly facing step, said steps comprising said interengaging formations.

8. The assembly as claimed in claim 5, wherein the headstone holder is formed separately from the two part lid member, the headstone holder and second part of the lid member having second interengaging formations for releasably mounting the headstone holder on the upper face of the lid member.

9. The assembly as claimed in claim 8, wherein the upper face of the lidmember has an elongate channel at said first end and the lower face of the headstone holder has a downwardly projecting rib for releasable engagement in said channel, the channel and rib comprising said second interengaging formations.

10. The assembly as claimed in claim 1, wherein the cavity has a lower end and the headstone holder has a drain hole communicating with the lower end of the cavity for draining of water from said cavity.

11. The assembly as claimed in claim 1, wherein the cavity has a lower end, opposite side walls and opposite end walls, the walls being inclined outwardly from the lower end to the open upper end of the cavity.

12. The assembly as claimed in claim 1, wherein the cavity has a height in the range from 15" to 16".

13. A headstone and vault lid assembly, comprising:

a flat, rectangular lid member for releasably closing the open upper end of the burial vault, the lid member having an upper face, a lower face, opposite first and second ends, and opposite sides;

a headstone holder projecting upwardly from the upper face of the first end of the lid member;

the headstone holder comprising a rectangular, box-shaped container having an upwardly extending rectangular cavity with an open upper end;

a generally rectangular, solid headstone having a lower end portion engaged in said rectangular cavity and an upper end portion projecting upwardly out of said headstone holder where the dimensions of the lower portion of the headstone are slightly less than those of the headstone cavity so as to leave a space between said headstone and cavity; and filler material in said space in said cavity surrounding said lower end portion of said headstone to support said headstone in an upright condition.

14. The assembly as claimed in claim 13, wherein said cavity has a lower end, and the headstone holder has a drain hole communicating with the lower end of said cavity for draining water from said cavity.

15. The assembly as claimed in claim 13, wherein the lid member and headstone holder are formed integrally.

16. The assembly as claimed in claim 13, where the lid has no openings or windows and is completely opaque.

17. A headstone and vault lid assembly, comprising:

a flat, rectangular lid member for releasably closing the open upper end of the burial vault, the lid member having an upper face, a lower face, opposite first and second ends, and opposite sides;

a headstone holder projecting upwardly from the upper face of the first end of the lid member;

the headstone holder comprising a rectangular, box-shaped container having an upwardly extending rectangular cavity with an open upper end;

a headstone having a lower end portion engaged in said rectangular cavity and an upper end portion projecting upwardly out of said headstone holder; and filler material in said cavity surrounding said lower end portion of said headstone to support said headstone in an upright condition, wherein the headstone holder is formed separately from the lid member, the headstone holder having a lower face and the upper face of the first end of the lid member and the lower face of the headstone holder having interengaging formations for releasably securing the headstone holder to the lid member.

18. The assembly as claimed in claim 13, wherein the cavity has a depth of around 16", the headstone has a height of around 42", and the upper end portion has a height of around 26".

19. A burial method for a vault, comprising the steps of:

installing a vault having a removable lid in an excavated hole in the ground at a predetermined depth below the ground level;

at the time of a first interment in the vault, removing the lid and inserting a first casket into the vault;

replacing the lid on the open upper end of a vault;

inserting the lower end portion of a headstone, which is a flat. rectangular member with imprinted informational indicia, into an upwardly facing, vertical cavity in a headstone holder projecting upwardly from a first end of the lid so that an upper end portion projects upwardly from the headstone holder above the ground level;

adding granular material to the cavity around the headstone to support the headstone in an upright configuration; and re-filling the hole with soil to cover the lid and headstone holder.

20. A burial method for a vault, comprising the steps of:

installing a vault having a removable lid in an excavated hole in the ground at a predetermined depth below the ground level:

at the time of a first interment in the vault, removing the lid and inserting a first casket into the vault:

replacing the lid on the open upper end of a vault:

inserting the lower end portion of a flat headstone into an upwardly facing, vertical cavity in a headstone holder projecting upwardly from a first end of the lid so that an upper end portion projects upwardly from the headstone holder above the ground level;

adding granular material to the cavity around the headstone to support the headstone in an upright configuration;

re-filling the hole with soil to cover the lid and headstone holder, wherein the vault is a multi-level vault having at least a lower level and an upper level separated by a removable floor and the first interment further comprising the steps of removing the lid and separating floor, inserting the first casket into the lower level of the vault and replacing the separating floor before replacing the lid, and a second interment comprises the steps of excavating the grave to uncover the lid, lifting a first part of the lid from the vault to expose part of the open upper end of the vault but leaving a separate, second part of the lid, the headstone holder, and the headstone in position over the vault, the first part of the lid comprising a major portion of the length of the lid, inserting a second casket into the upper level of the vault via the exposed part of the open upper end, replacing the first part of the lid over the vault, and re-covering the lid with soil up to the ground level.

* * * * *